United States Patent [19]

Kodama et al.

[11] Patent Number: 5,057,040

[45] Date of Patent: Oct. 15, 1991

[54] CONNECTOR TERMINAL ENGAGE STRUCTURE

[75] Inventors: Shinji Kodama; Satoshi Yamada; Sakai Yagi, all of Shizuoka, Japan

[73] Assignee: Yazaki Corporation, Japan

[21] Appl. No.: 651,559

[22] Filed: Feb. 6, 1991

[30] Foreign Application Priority Data

Feb. 8, 1990 [JP] Japan ..... 2-11044[U]

[51] Int. Cl.[5] ..... H01R 13/40

[52] U.S. Cl. ..... 439/595; 439/595

[58] Field of Search ..... 439/594–596, 439/592

[56] References Cited

U.S. PATENT DOCUMENTS

| | | | |
|---|---|---|---|
| 4,329,009 | 5/1982 | Bungo | 439/595 |
| 4,664,460 | 5/1987 | Vandame | 439/595 |
| 5,009,615 | 4/1991 | Mobley et al. | 439/595 |

*Primary Examiner*—Paula A. Bradley

*Attorney, Agent, or Firm*—Wigman & Cohen

[57] ABSTRACT

The connector terminal engage structure comprises: a female connector terminal and a connector housing having first and second engage arm members for supporting the female connector terminal therebetween and an arm holding member for holding at least one of the two engage arm members away from the female connector terminal when the terminal is required to be removed from the connector housing. Since one of the two terminal engage arm members can be deformed away from the terminal by a jig so as to be held by the arm holding member, it is possible to easily remove the terminal from the housing whenever required, even after the connector has been left at high temperature and therefore the resin engage arm means have been deformed plastically without elasticity.

6 Claims, 5 Drawing Sheets

CONNECTOR TERMINAL ENGAGE STRUCTURE

BACKGROUND OF THE INVENTION

1. Field of the Invention

The present invention relates to a connector terminal engage structure for a wire connector suitable for use in wire harness, etc., and more specifically to a connector terminal engage structure resistant against high temperature.

2. Description of the Prior Art

FIGS. 1(*a*), (*b*), (*c*) and (*d*) show an example of prior-art connectors, which is disclosed in Japanese Published Unexamined (Kokai) Patent Appli. No. 61-42883.

FIG. 1(*a*) shows a male connector terminal 101 and a female connector terminal 102. The female connector terminal 102 is formed with a dumbbell-shaped section female contact terminal portion 103 mated with the male connector terminal 101 and two first wire cramping portions 104 and two second wire cramping portions 105, respectively for fixing a conductive wire thereto. Near the free end of the female terminal portion 103, two projecting engage portions 106A are formed. Further, although not shown in FIG. 1(*a*), another convex engage portion 106B is formed in the female terminal contact portion 103 as shown by the dot-dashed line in FIG. 1(*c*).

FIG. 1(*b*) shows a connector housing 110 for housing the two female connector terminal 102 as shown in FIG. 1(*a*). With reference to FIGS. 1(*b*) and 1(*d*), the connector housing 110 is formed with two terminal housing hollow potions 111A and 111B partitioned by a middle fork-shaped arm member 112 composed of two arm portions 112A and 112B, and a pair of symmetrical arm members 113A and 113B extending inwardly from the inner side surfaces of the housing 110, respectively so as to form each fork-shaped arm member in cooperation with back side wall 115A or 115B. The arm portion 112A of the middle fork-shaped arm member 112 is formed with a stepped engage portion 112A-1; the arm portion 112B thereof is formed with a stepped engage portion 112B-1; the arm portion 113A is formed with a stepped engage portion 113A-1; and the arm portion 113B is formed with a stepped engage portion 113B-1, respectively.

Therefore, when the female connector terminal 102 cramped to a conductive wire is inserted into the terminal housing hollows portion 111A from above in FIG. 1(*d*) as show by a dot-dashed line in FIGS. 1(*b*) and 1(*c*), the two projecting engage portions 106A of the female connector terminal 101 are brought into engagement with the stepped engage portion 112A-1 of the arm member 112A, and the convex engage portion 106B of the female connector terminal 101 is brought into engagement with the stepped engage portion 113A-1 of the arm portion 113A, so that the female connector terminal 102 can be elastically supported or sandwiched between the two arm portions 112A and 113A within the connector housing 110.

Here, it should be noted that the reason why the female connector terminal 102 is elastically housed within the connector housing 110 between the two elastic fork-shaped arm members is that the male connector member 101 not accurately aligned with the female connector terminal 102 can be easily mated with the female connector terminal 102 owing to the transversal deformation of the fork-shaped arm members 113A and 112A in either direction within the connector housing 110.

Further, when the inserted female connector terminal 102 is required to be removed from the connector housing 110, a jig (not shown) is used to elastically deform the elastic fork-shaped arm members so that each stepped engage portion 113A-1, 112A-1, 112B-1 or 113B-1 can be moved away from each projecting or convex engage portion 106A or 106B of the female connector terminal 102.

In the above-mentioned prior-art connector terminal engage structure as shown in FIGS. 1(*a*) to 1(*d*), however, there exists a problem in that when the connector housing 13 has been left within a high temperature atmosphere for many hours, since the elastic fork-shaped arm members are plastically deformed without elasticity, it is impossible to deform the arm members or move the stepped engage portions of the arm members away from the female connector terminal, even if a jig is fitted into the connector housing.

SUMMARY OF THE INVENTION

With these problems in mind, therefore, it is the primary object of the present invention to provide a connector terminal engage structure by which a connector terminal is easily removable even after the connector has been left at high temperature for many hours and therefore the terminal engage arm members have been deformed plastically without any elasticity.

To achieve the above-mentioned object, the connector terminal engage structure according to the present invention comprises: (a) connector terminal (10); and (b) a connector housing (20) for housing said connector terminal, said connector housing having: (1) first engage arm means (23) for supporting said connector terminal; (2) second engage arm means (24) for supporting said connector terminal in cooperation with said first engage arm means; and (3) arm holding means (30) for holding at least one of said first and second engage arm means away from said connector terminal when said connector terminal is required to be removed from said connector housing.

The second engage arm means (24) is formed with two side projections (24*a* -2) at a free end thereof, and said arm holding means (30) is formed with two U-shaped end portions (32*a*, 32*b*each having an inner projection (32a-1, 32b-1) extending along a middle cutout portion (31) so as to be engageable with each side projection (24*a* -2) of said second engage arm means (24), respectively, when said second engage arm means (24) is held by said arm holding means (30).

Further, when the connector terminal is a female connector terminal, the terminal is formed with a first projecting engage portion (13) and a second stepped engage portion (14). The first engage arm means (23) is formed with a recessed engage portion (23*a*) engageable with said first projecting engage portion (13) of said female connector terminal, and the second engage arm means (24) is formed with a projecting engage portion (24*a* ) engageable with said second stepped engage portion (14) of said female connector terminal.

In the connector terminal engage structure according to the present invention. Since at least one of the two terminal engage arm means is deformed away from the connector terminal by use of a jig and then held by the arm holding means whenever the connector terminal is required to the removed from the connector housing, it is possible to easily remove the connector terminal from the connector housing, even after the connector housing has been left at high temperature for many hours and therefore the engage arm means have deformed practically without any elasticity.

BRIEF DESCRIPTION OF THE DRAWINGS

FIG. 1(*b*) is a perspective, partially broken view showing a connector housing of the same prior-art connector;

FIG. 1(*c*) is a front view showing the connector housing of the same prior-art connector;

FIG. 1(*d*) is a cross-sectional view taken along the line 1*d*—1*d* shown in FIG. 1(*c*);

FIG. 2(*b*) is an enlarged perspecitve view showing a connector terminal engage arm member and an arm holding member formed in a connector housing according to the present invention;

FIG. 3(*b*) is an enlarged front view showing the same;

FIG. 4(*b*) is an enlarged perspective view similar to FIG. 2(*b*), for assistance in explaining the same removing method.

DETAILED DESCRIPTION OF THE PREFERRED EMBODIMENT

Figure 1A:
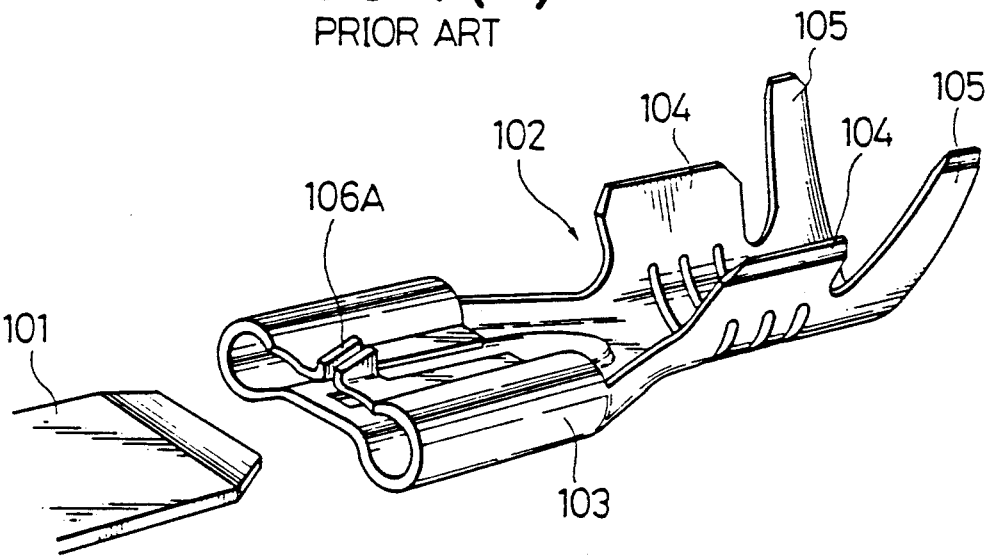
FIG. 1(a) PRIOR ART
FIG. 1(*a*) is a perspective view showing an example of female connector terminal engage structure of a prior-art connector.
Figure 1B:
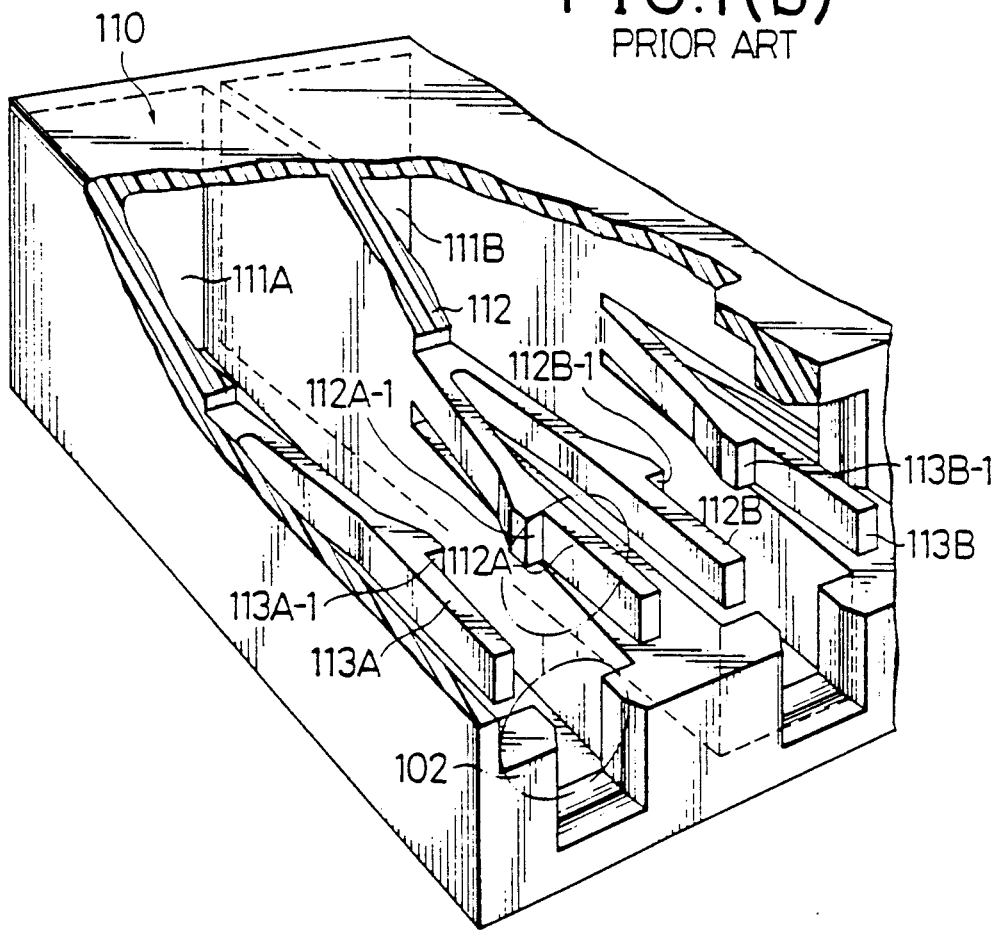
FIG. 1(b) PRIOR ART
Figure 1C:
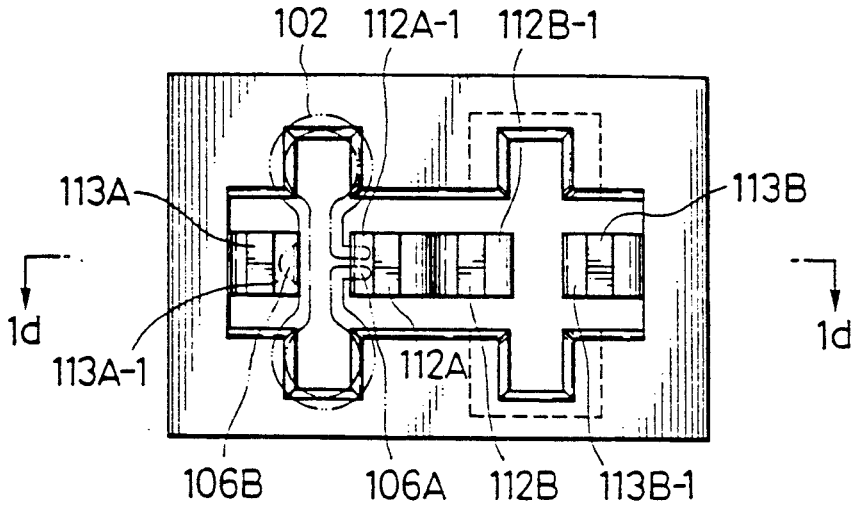
FIG.1(c) PRIOR ART
Figure 1D:
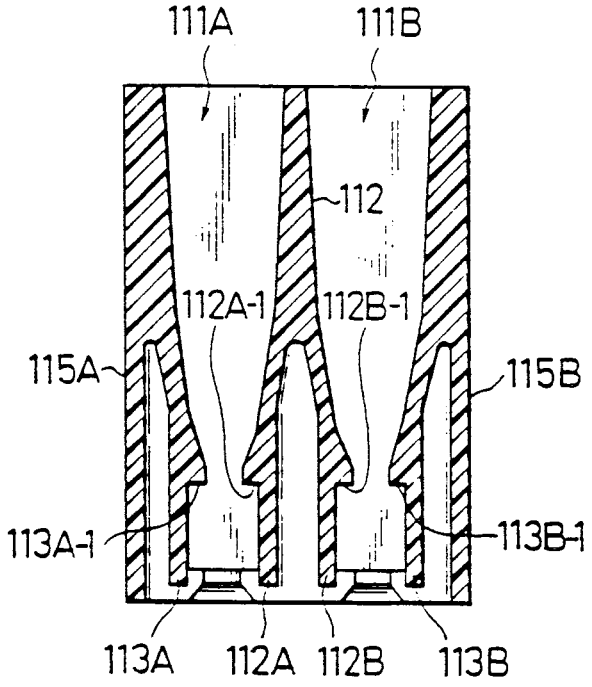
FIG.1(d) PRIOR ART
Figure 2A:
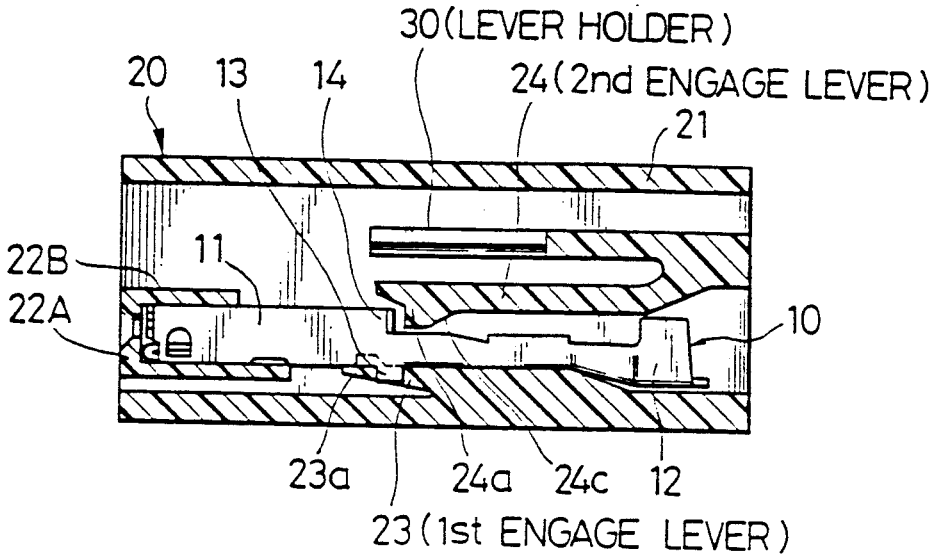
FIG. 2(*a*) is a cross-sectional views showing an embodiment of the connector terminal engage structure according to the present invention.
Figure 2B:
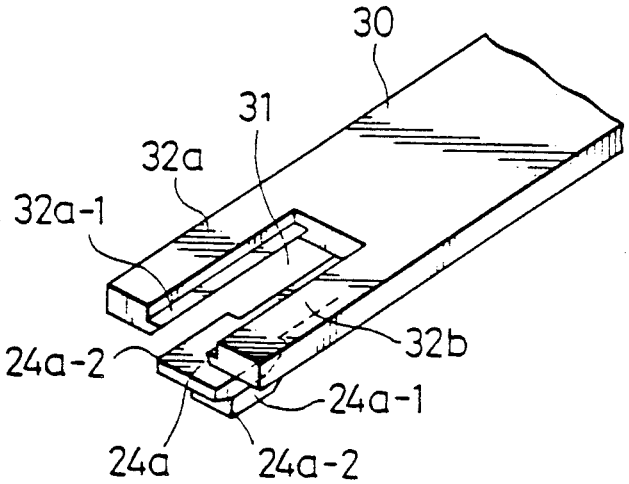
Figure 3A:
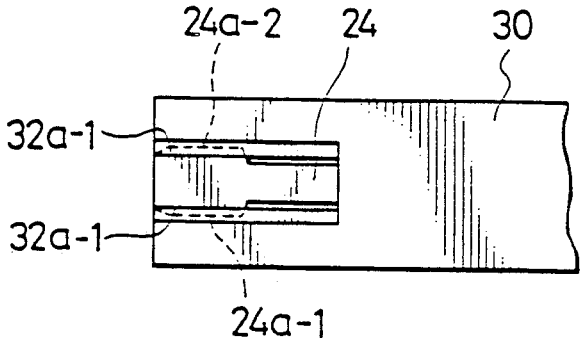
FIG. 3(*a*) is an enlarged plan view showing the same engage arm member and holding member.
Figure 3B:
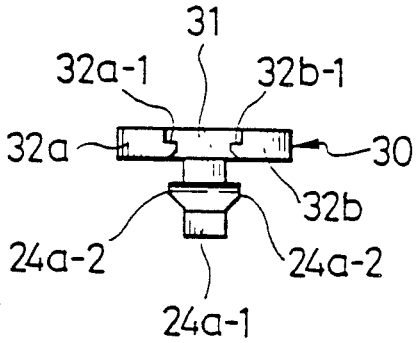

With reference to the attached drawings, the connector terminal engage structure according to the present invention will be described hereinbelow. In FIGS. 2(*a*) and 2(*b*), a female connector terminal 10 is formed with a metallic female contact terminal portion 11 mated with a male connector terminal (not shown) and a wire cramping portion 12 for fixing a conductive wire. Near the middle portion of the female terminal 10, there are formed a first projecting engage portion 13 similar to that 106B shown in FIG. 1(*c*) and a second stepped engage portion 14 similar to that 106A shown in FIG. 1(*a*). Although not shown in detail, the cross section of the female connector terminal 10 is formed into any shape such as a dumbbell shape, rectangular shape, etc. Further, it is also possible to replace the above-mentioned female connector terminal with a male terminal.

On the other hand, a resin connector housing 20 is formed with an outer casing 21, two inner front stopper members 22A and 22B for stopping a front end surface of the female connector terminal 10, a first flexible engage arm member (first engage arm means) 23 extending from an inner side surface of the connector housing 21, a second flexible engage arm member (second engage arm means) 24 extending from an engage arm holding member (arm holding means) 30. The first flexible engage arm member 23 is formed with a portion 23*a* near the free end thereof so as to engaged with the projecting engage portion 13 of the female connector terminal 10. The second flexible engage arm member 24 is formed with a projecting engage portion 24*a* near the free end thereof so as to be engaged with the stepped engage portion 14 of the female connector terminal 10.

The feature of the engage structure according to the present invention is to additionally form the engage arm holding member 30 within the connector housing 20. In more detail with reference to FIGS. 2(*b*), 3(*a*) and 3(*b*), the free end of the engage arm holding member 30 is formed into a U-shape at the free end thereof. That is, a flexible arm holding cutout portion 31 is formed between the two straight arm end portions 32*a* and 32*b* each formed with an inner projection 32a-1 or 32b-1 extending along with the cutout portion 31, respectively.

Further, the free end of the second flexible engage arm member 24 is formed into a T-shape at the free end thereof. That is, the second engage arm member 24 is formed with a projecting engage portion 24*a* having an under projection 24a-1 engaged with the stepped engage portion 14 of the female connector terminal 10 and two side projections 24a-2 engaged with the two inner projections 32a-1 and 32b-1 of the arm holding memo 30.

In assembly, the female connector terminal 11 to which a conductive wire is cramped is inserted from the right side of the connector housing 20 in FIG. 2(*a*). In this case, the female contact terminal portion 11 is first brought into contact with a slope surface 24*c* of the second flexible engage arm member 24 to deform the arm member 24 away from the inserted female connector terminal 10 until the front end of the connector terminal 10 is brought into contact with the front stopper members 22A and 22B so that the stepped engage projection 14 is engaged with the projecting engage portion 24*a* of the second engage arm member 24. On the other hand, the convex engage portion 13 of the female connector terminal 10 deforms the first flexible engage arm member 23 away from the inserted female connector terminal 10 until the front end of the connector terminal 10 is brought into contact with the front stopper members 22A and 22B so that the convex engage portion 13 is engaged with the recessed engage portion 23*a* of the first flexible engage arm member 23. Under these conditions, the connector terminal 10 is housed or supported within the connector housing 20.

Figure 4A:
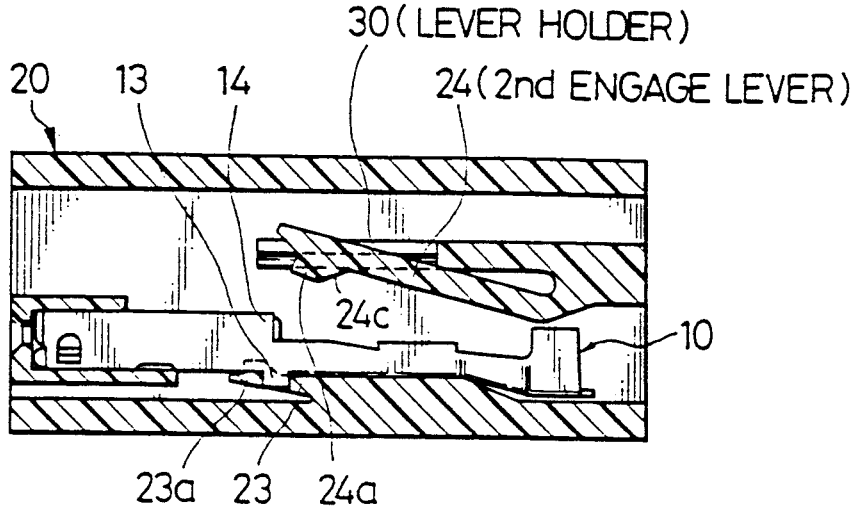
FIG. 4(*a*) is a cross-sectional view similar to FIG. 2(*a*), for assistance in explaining the method of removing the female connector terminal from the connector housing.
Figure 4B:
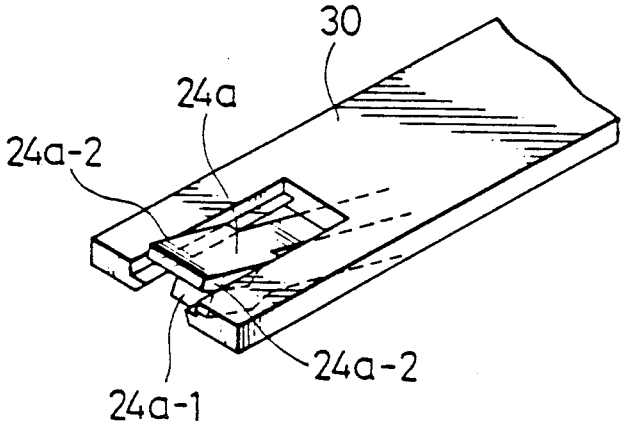

To remove the female connector terminal 10 from the connector housing 20, a first jig (not shown) is inserted into the connector housing 20 from the left side thereof in FIG. 2(*a*) to deform the second engage arm member 24 toward the arm holding member 30 until the second engage arm member 24 is held by the arm holding member 24 as shown in FIGS. 4(*a*) and 4(*b*). In these conditions, the two side projections 24a-2 of the projecting engage portion 24*a* of the second engage arm member 24 are engaged with the two inner projections 32a-1 and 32b-1 of the arm holding member 30, respectively, so that the second engage arm member 24 is securely separated away from the female connector terminal 10. Under these conditions, a second jig (not shown) is inserted into the female connector housing 20 from the left side of the connector housing 20 in FIG. 4(*a*) to disengage the convex engage portion 13 of the female connector terminal 10 from the recessed engage portion 23*a* of the first flexible engage arm member 23, before removing the female connector terminal 10 from the connector housing 20.

As described above, in the connector terminal engage structure according to the present invention, since the two flexible engage arm members are formed within the connector housing to support the connector terminal within the housing and further the engage arm holding member is additionally formed within the connector housing so as to hold any one of the two flexible engaged arm members away from the connector terminal when the connector terminal is required to be removed from the connector housing, it is possible to easily remove the metallic connector terminal from resin the connector housing, in case the two flexible engage arm members have been deformed plastically into non-elastic state due to high temperature.

What is claimed is:

1. A connector terminal engage structure, comprising:

(a) a connector terminal; and (b) a connector housing for housing said connector terminal, said connector housing having:

(1) first engage arm means for supporting said connector terminal;

(2) second engage arm means for supporting said connector terminal in cooperation with said first engage arm means; and (3) arm holding means for holding at least one of said first and second engage arm means away from said connector terminal when said connector terminal is required to be removed from said connector housing.

2. The connector terminal engage structure of claim 1, wherein said second engage arm means is formed with two side projections at a free end thereof, and said arm holding means is formed with two U-shaped end portions each having an inner projection extending along a middle cutout portion so as to be engageable with each side projection of said second engage arm means, respectively, when said second engage arm means is held by said arm holding means.

3. The connector terminal engage structure of claim 1, wherein said connector terminal is a female connector terminal.

4. The connector terminal engage structure of claim 3, wherein said female connector terminal is formed with a first projecting engage portion and a second stepped engage portion.

5. The connector terminal engage structure of claim 4, wherein said first engage arm means is formed with a recessed engage portion engageable with said first projecting engage portion of said female connector terminal.

6. The connector terminal engage structure of claim 4, wherein said second engage arm means is formed with a projecting engage portion engageable with said second stepped engage portion of said female connector terminal.

* * * * *

UNITED STATES PATENT AND TRADEMARK OFFICE

CERTIFICATE OF CORRECTION

PATENT NO. : 5,057,040

DATED : October 15, 1991

INVENTOR(S) : Shinju Kodama, et al

It is certified that error appears in the above-identified patent and that said Letters Patent is hereby corrected as shown below:

Column 2, line 46, "(32a, 32beach" should be --(32a, 32b) each--.

Signed and Sealed this

Thirtieth Day of November, 1993

*Attest:*

*Attesting Officer*

BRUCE LEHMAN

*Commissioner of Patents and Trademarks*